US005370058A

United States Patent [19]

David

[11] Patent Number: 5,370,058

[45] Date of Patent: Dec. 6, 1994

[54] LOW RISE DROP YOKE SYSTEM

[75] Inventor: Patrick G. David, Welland, Canada

[73] Assignee: Whiting Equipment Canada Inc., Welland, Canada

[21] Appl. No.: 151,747

[22] Filed: Nov. 15, 1993

[51] Int. Cl.[5] ..... B61K 5/00

[52] U.S. Cl. ..... 104/32.1; 29/402.08; 29/426.3

[58] Field of Search ..... 104/32.1; 414/426, 427; 29/402.08, 426.3, 803, 824

[56] References Cited

U.S. PATENT DOCUMENTS

| | | | |
|---|---|---|---|
| RE. 16,989 | 6/1928 | Waters | 104/32 |
| 94,680 | 9/1869 | Wells | 104/32.1 |
| 265,366 | 10/1882 | Atkinson | 104/32.1 |
| 304,562 | 9/1884 | Ramsey | 104/32.1 |
| 1,163,105 | 12/1915 | Pamplin et al. | 104/32.1 |
| 1,586,783 | 6/1926 | Coffey . | |
| 1,632,256 | 6/1927 | Walter . | |
| 1,706,211 | 3/1929 | Coffey . | |
| 1,802,592 | 4/1931 | Christie . | |
| 1,848,696 | 3/1932 | Christie . | |
| 2,454,225 | 11/1948 | Skinner | 104/32.1 |
| 2,454,226 | 11/1948 | Skinner | 104/32 |
| 2,554,145 | 5/1951 | Holdeman | 104/32 |
| 2,640,435 | 6/1953 | Griffiths | 104/32 |
| 2,640,436 | 6/1953 | Holmes et al. | 104/32 |
| 2,652,284 | 9/1953 | Holmes et al. | 104/32.1 |
| 2,655,114 | 10/1953 | Holdeman et al. | 104/32 |
| 2,655,115 | 10/1953 | Holdeman et al. | 104/32 |
| 2,716,949 | 9/1955 | Converse | 104/32 |
| 2,718,851 | 9/1955 | Holdeman | 104/32 |
| 2,735,376 | 2/1956 | Holdeman | 104/32.1 |
| 3,055,310 | 9/1962 | Griffiths et al. | 104/32 |
| 4,295,427 | 10/1981 | Waterman et al. | 104/32 |

FOREIGN PATENT DOCUMENTS

| | | | |
|---|---|---|---|
| 0287692 | 3/1991 | Germany | 104/32.1 |
| 0289248 | 4/1991 | Germany | 104/32.1 |

*Primary Examiner*—Mark T. Le
*Attorney, Agent, or Firm*—Rothwell, Figg, Ernst & Kurz

[57] ABSTRACT

A train or a significant portion thereof comprising coupled freight or passenger cars or a close coupled multi-car "pack" of cars, including one or more with defective running gear are diverted to a service track, having a first work station incorporating a working "gap" overlying a lateral trench. The rails of the track, at the trench, are reinforced, and pivotted as swing rails, for lateral retraction alongside the trench. A track having a trolley thereon can move along the bottom of the trench between the first work station and a second similarly, equipped work station. The trolley has a low-boy, high capacity jack capable of raising the axle together with the associated car end or ends, to be blocked-up in-situ. The pivotted swing rails are retracted permitting tile defective wheel set to be lowered clear of the car, and the trolley then moved back along the trench to the second work station, which has a second service track extending parallel with the first service track and also has swing rails there across. At the second work station the defective wheel set is replaced by a replacement set from the second service track. The procedure is then reversed to substitute the replacement wheel set beneath the car, which is then returned to service with the still coupled train, all within a matter of a few hours. Actual wheel set replacement can be reduced to one hour, operated by one man, and eliminates the three day break down and reassembly time for a train.

22 Claims, 8 Drawing Sheets

LOW RISE DROP YOKE SYSTEM

TECHNICAL FIELD

This invention is directed to a system for the replacement of defective running gear on a train, and in particular, to the replacement of wheel sets on rail cars.

BACKGROUND ART

In the operation of railroads there is an ongoing need to replace defective running gear of the rail cars, running gear that has failed or is failing in service. In most trains there is usually present an average of three defective wheel sets. The presence of these defective sets may be determined aurally, by the squealing and grinding of the wheel flanges against the rails, by the thumping of tread flat spots on the rail; by visual inspection: and frequently by the operation of infra-red "hot-box" detectors.

Trains on the North American continent may operate with individual cars standard-coupled together, or the cars are semi-permanently coupled together in close-coupled sub-units such as five car, six car or ten car "packs", being typically referred to as a "five pack", a "six pack", etc., having semi-permanent coupling and service connections.

Present practice for the replacement of defective running gear requires the breaking down of the train to isolate the affected freight or passenger car, including, where necessary, the uncoupling of the semi-permanent connections to the defective car, so that it can be shunted no a car shop or service area, and the repair effected by substituting a serviced wheel set for the defective set, using an overhead lifting system to raise cars bodily from the affected wheel set. The tonal servicing process regularly requires as much as three days, largely to separate the effected cars; shunting them from the train and then shunting them, one at a time, to the car shop or service area, while a time of about three hours is required to carry out the actual replacement of each wheel replacement set, before the train can be reassembled, re-connected and returned to service. Meanwhile, the trainload of goods being transported is delayed, with possible spoilage, interrupted schedules, etc.

The separation of passenger rail cars is complicated by the frequent requirement to disconnect electric heating, door operation, etc. which are labour intensive and time consuming.

Three-level automobile carrier cars present yet more difficulties as they may not be lifted by cranes.

In the case of the modern practice of "critical path" supply of components, in industries such as the automotive industry, this type of delay is highly undesirable, and in many instances eliminates railroads from consideration as a potential carrier. Also, in the case of perishables, particularly fruit, the same applies, with reliance consequently being vested in the aircraft and trucking industries.

The delay presently involved in changing a defective wheel set is so adverse to effective train service that the decision to remedy the defect may be postponed, and a safety hazard occurs, with possible tragic consequences.

The present method of servicing individual rail cars within car shops typically relies upon the use of a trolley having a heavy duty mechanical lift, extending far beneath the trolley, into an elongated deep well extending the length of the service pit.

The lift has a ram housed in an elongated tubular housing suspended beneath the servicing trolley, the tube extending several feet below the trolley and its tracks, and being accommodated within a deep well, located in the bottom of the service pit, and extending along its length. This well most usually contains accumulated garbage, and frequently becomes filled with ground-water, ice or other water. The service pit enables the lateral transfer of a disabled truck or wheel set clear of the car, for replacement by a serviced set, using a crane or other lifting equipment to substitute the serviced set for the defective unit upon the servicing trolley.

Various aspects and examples of such service or "drop" pits, and the hoisting mechanisms associated therewith are to be found in U.S. Pat. Nos.:

1,586,783- Coffey - June 1926;
1,632,256- Walter - June 1927;
1,706,211- Coffey - March 1929;
1,802,592- Christie - April 1931;
1,848,696- Christie - March 1932; and
3,055,310- Griffiths et al. - September 1962.

The use of such drop pits and associated facilities has more recently been complicated by the adoption of trains of semi-permanently, close coupled railway cars in multi-car packs, the disconnection of which is both labour intensive, time consuming and dangerous.

U.S. Pat. No. 4,295,427 shows a plant for refurbishing the trucks of railway car running gear, and includes a lateral transfer line along which the defective trucks and associated replacement trucks travel.

DISCLOSURE OF THE INVENTION

The present invention provides a system for the rapid replacement of defective wheel set units of a train comprising a plurality of cars, which may include individually coupled freight cars or passenger cars, or wherein some or all of the cars may be semi-permanently close-coupled into sub-units such as "packs". The system includes the steps of sidelining the train and its defective freight or passenger cars, or its packs of close-coupled cars, onto a service track having a first work station; positioning the defective wheel set unit over a service trench; raising clear of the track rails the defective wheel set unit and associated car-end (or car-ends, in the case of the semi-permanently close-coupled cars of a pack); blocking the car end or adjoining ends in supported relation; retracting portions of the rails overlying the trench to an adjoining position substantially clear of the trench; lowering the defective wheel set unit into the trench, below the car; transporting the wheel set unit along the trench clear of the car; removing the defective wheel set unit and substituting a serviceable wheel set unit therefor; and returning and replacing the serviceable unit beneath the car; returning the retracted rail portions to their working position, and unblocking and lowering the car or cars onto the rails, and returning the train to service.

Thus there is provided a process for electively and rapidly changing a defective wheel set unit of a rail car out of doors, wherein the rail car comprises one unit or a plurality of semi-permanently connected rail cars, comprising the steps of: providing a pair of spaced apart work stations having a jacking trolley within a trench interconnecting the work stations; a first work station extending beneath a service track having rail portions thereof over the trench removably retractable alongside the trench to give enhanced access between the trolley and the rail car when located thereover; the system further including the steps of: locating the defective wheel set unit in positioned relation over the jack of the jacking trolley; raising the jack to engage the axle of the wheel set unit; raising the jack to lift the wheels of the wheel set unit clear of the retractable rail portions, and to raise the associated car end or ends; blocking a portion of the car or cars in raised, immovable relation; retracting the movable rail portions and lowering the jack and the defective wheel set unit below the rail car; withdrawing the trolley together with the defective wheel set unit to the second work station; removing the defective wheel set unit and substituting a replacement wheel set unit therefor; returning the trolley, together with the replacement unit to the first work station; raising the jack to position the replacement wheel set unit in engaged lifting relation with the rail car end or ends, to raise the car end or ends from off the supporting blocks; re-deploying the movable rail portions beneath the wheel set unit, and removing the car blocks; lowering the jack to locate the wheel set unit in operative engaging relation with the rail portions; retracting the jack downwardly clear of the car, and returning into service the serviced car and coupled cars.

The operations of the car blocks, both for insertion and removal, may be readily automated.

In order to carry out the present invention there is provided an open-air service track, intersected by a first, below-grade work station comprising a trench containing a trolley that is movable therealong. The rails of the service track, where they extend over the trench, are retractable, to permit the substantially unrestricted passage of the trolley in a loaded condition along the trench, for transportation by the trolley of the defective wheel set assembly.

While the retractable rail portions may be manually retracted and re-deployed, it will be understood that these retractable rail portions may also be powered, for powered retraction and re-deployment.

The trolley has a low-boy, high capacity jack, capable of lifting one end or a pair of adjacent car ends of loaded freight cars by way of an axle, such that the car or cars can be blocked up in raised position, and the wheel set removed merely by downward displacement of the jack, once the supporting rails are retracted. In the case of a pack of cars wherein the defective wheel set is located near an adjoining car, the jack is capable of raising the two adjoining car ends, for blocking up in the raised condition. Blocking jacks located adjacent the track, on both sides of the trench, permit the removal of a front or a rear wheel set from a truck.

Preferably a buttress-threaded, large diameter jack shaft is mounted within a worn-driven nut, for actuation thereof by a prime-mover such as an A.C. induction motor. The driving nut is set sufficiently low upon the trolley to give sufficient clearance for lowering the jack and its load of a wheel set unit clear of the car undercarriage, while the lower end of the jack shaft projects down into its protective housing, which extends downwardly beneath the trolley almost to the trench floor, permitting travel of the loaded trolley along the trench.

It will be understood that a hydraulic jack may be used for these purposes.

In a preferred installation embodiment a second open air release track is provided, substantially parallel with the service track, and having similar provision of retractable rails overlying the trench, and forming a second work station.

With a supply of replacement wheel sets located upon the release track, to one side of, and adjacent the trench, it is a simple matter to manipulate the movable rail components of the second work station and the trolley jack so as to relocate the just-removed defective wheel set upon the rails of the release track adjacent the second work station, and on the side thereof opposite from the replacement units, and to then substitute a replacement wheel set therefore from the assembled supply.

It will be understood that alternative supply provisions, such as a mobile crane or walking beam conveyor may complement the second work station.

The present invention thus further provides an installation embodiment having a service track to receive a train or portion thereof in standing relation thereupon, having a trench therebeneath in transversely oriented relation to the service track.

Portions of the rails of the service track overlying the trench are retractable into adjacent relation with the sides of the trench.

A trolley within the trench has a low-boy, large load capacity jack thereon capable of raising a wheel set, clear of the rails, together with a related portion of the weight of a loaded rail car or the two adjoined ends of a pair of close-coupled cars forming part of a multi-car pack, for the blocking up of the raised portion of the rail car or cars.

The jack may be lowered to a sufficient extent (about two to three feet) for the wheel set unit to clear the undercarriage of the car, so that the trolley and its load may be moved along the trench, clear of the train.

In a preferred embodiment having a large diameter, electro/mechanically driven screw jack ram, a protective housing for the ram extends downwardly between the wheels and their supporting rails, almost to the floor of the trench, to achieve the desired lifting and lowering range of jack movement within the confines of the trench. The length of the trolley exceeds by a few feet the width of the track on which the train and its cars stand such that the operator has safe access to the running gear from all sides.

The provision of a remote, pendant control for the motor of the jack and located at one end of the platform, enables operation of the system by a single individual, preferably standing on the working platform of the trolley, in safely spaced relation from the jack and its load, and with an unobstructed field of vision of the car undercarriage, while the central location of the jack ram, projecting upwardly through the central portion of that platform, and having the associated gear box located above the platform and the drive motor located beneath the floor of the trolley, provides an unobstructed and ample access area for the operator, at a suitable working height relative to the car undercarriage, wheel bearings and truck saddles, etc., and also the retractable rail track portions.

The system, particularly with powered retractable swing rails, readily lends itself to full or semiautomatic operation. The present system also lends itself to installation on a main line, with the provision of one or more release tracks adjacent thereto. A tandem trolley may be employed, of such length that the two, spaced-apart jacks thereof are in registry simultaneously with a respective service track and adjacent release track, to thereby enable work being performed simultaneously at both locations, with consequent time savings. This also enables the effective employment of two release tracks, on opposite sides of the service track.

BRIEF DESCRIPTION OF THE DRAWINGS

Certain embodiments of the invention are described, by way of illustration, without limitation of the invention thereto, reference being made to the accompanying drawings, wherein.

BEST MODE OF CARRYING OUT THE INVENTION

Figure 1:
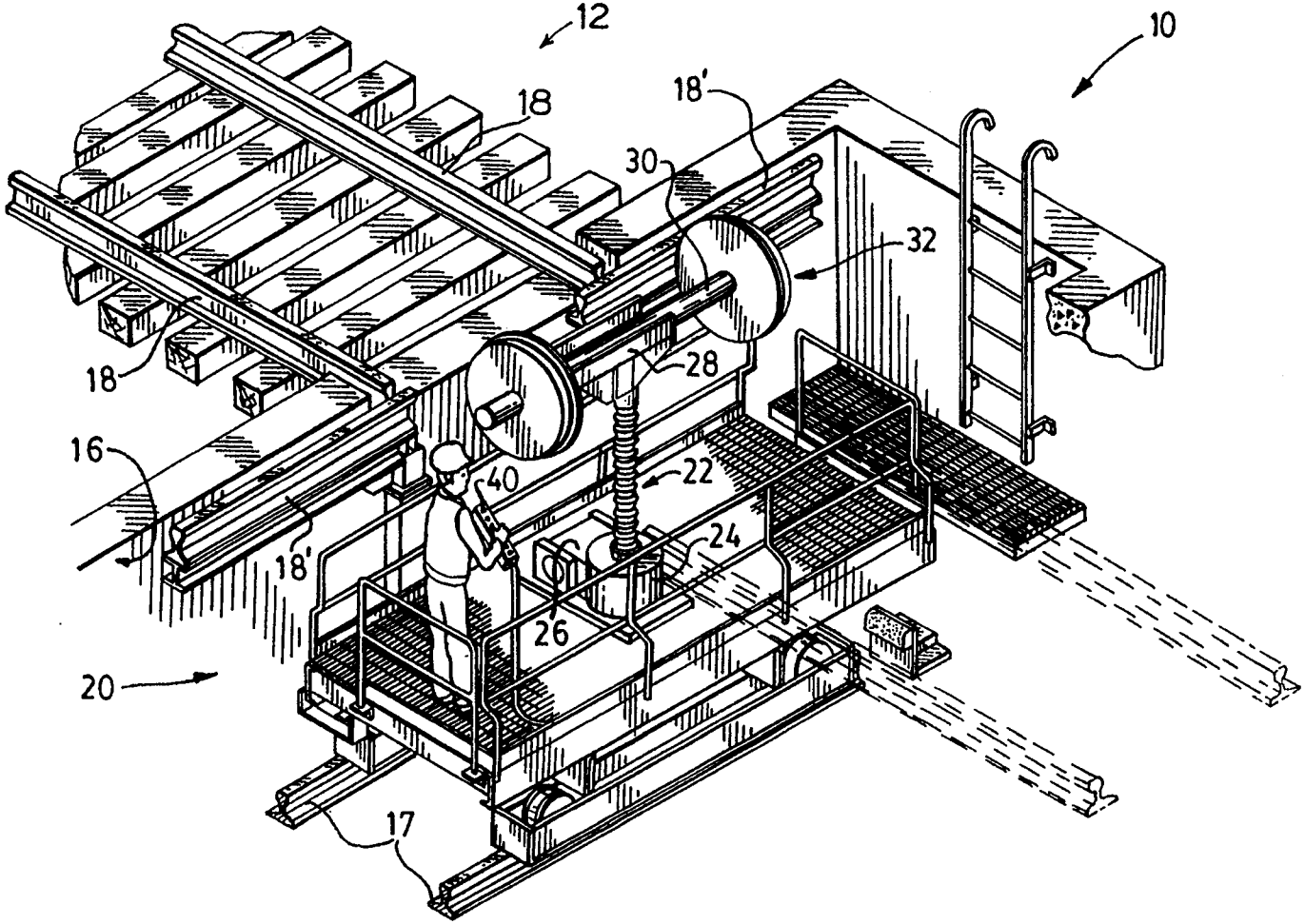
FIG. 1 is a perspective view, looking down, of a portion of a service track installation incorporating the present invention.
Figure 3:
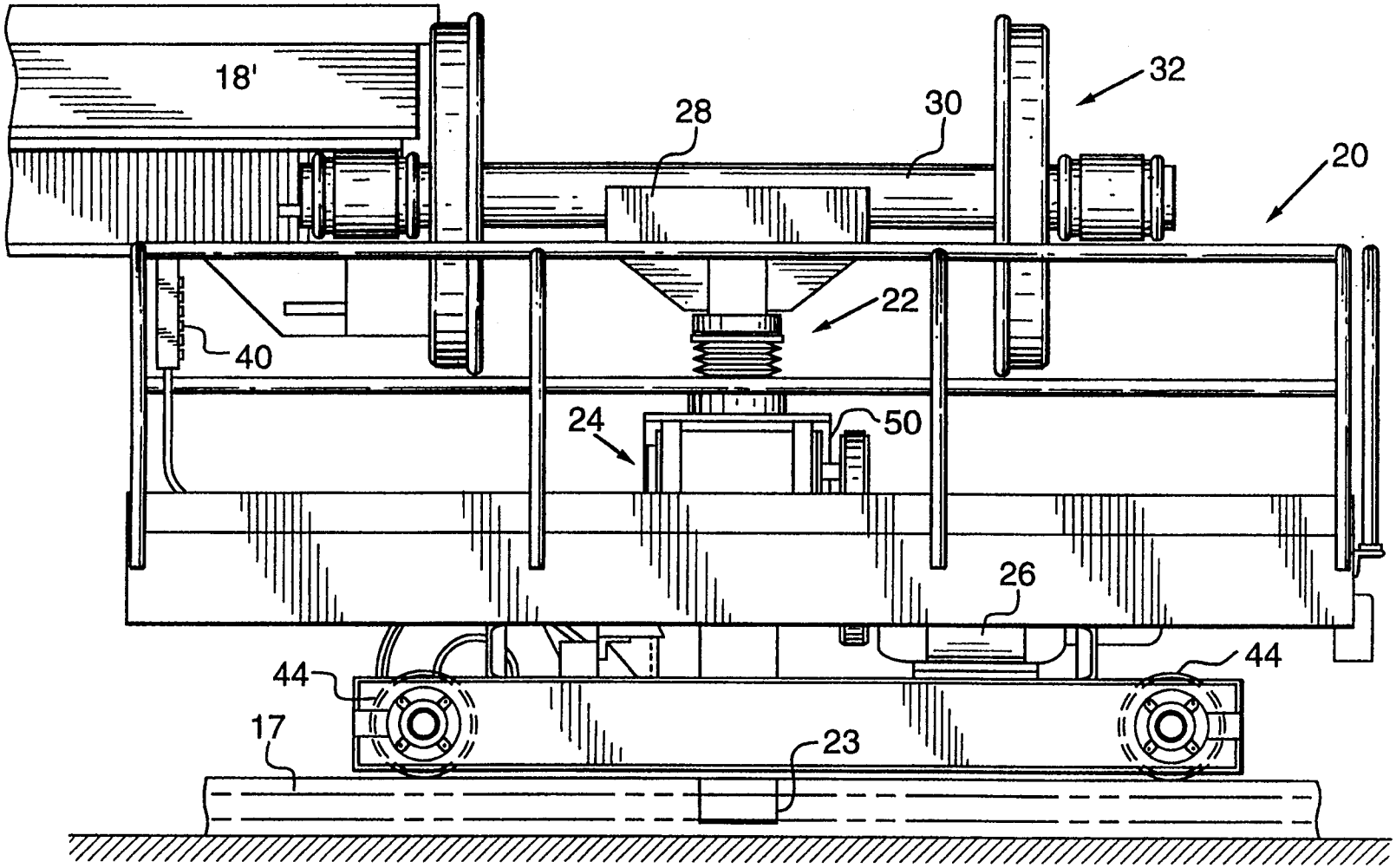
FIG. 3 is a side view of the trolley in accordance with the present invention.

Referring to FIGS. 1 and 3, a first work station 10 is shown, lying below and extending normally to a service track 12, the near-side rail lines of which are indicated mainly in phantom, the track 12 being of sufficient extent to accommodate a train or desired portion thereof.

Within a trench 16, having rail lines 17 therein is located a trolley 20 having a low-boy jack 22 thereon. The jack 22 has a supporting worn-driven nut mechanism 24, with an electric drive motor 26.

The upper end of jack 22 has a U-section yoke 28 to receive an axle 30 of wheel/axle set 32 in oriented relation therein.

The lower end of jack 22 is illustrated as protruding beneath the trolley 20, within a protective casing 23.

The reinforced movable or "swing" rail portions $18^1$ of the rail lines 18 are pivotally mounted at 34 adjacent the far edge of the trench 16, being illustrated in the retracted condition. When deployed, the swing rail portions $18^1$ span the trench 16, and complete the track thereacross.

An electric motor 26 in driving relation with worn-driven nut mechanism 24 is controlled by a pendant controller 40, to enable one-man operation, with up and down displacement of the wheel set 32, and subsequently, of its replacement, all by way of jack 22.

Figure 2:
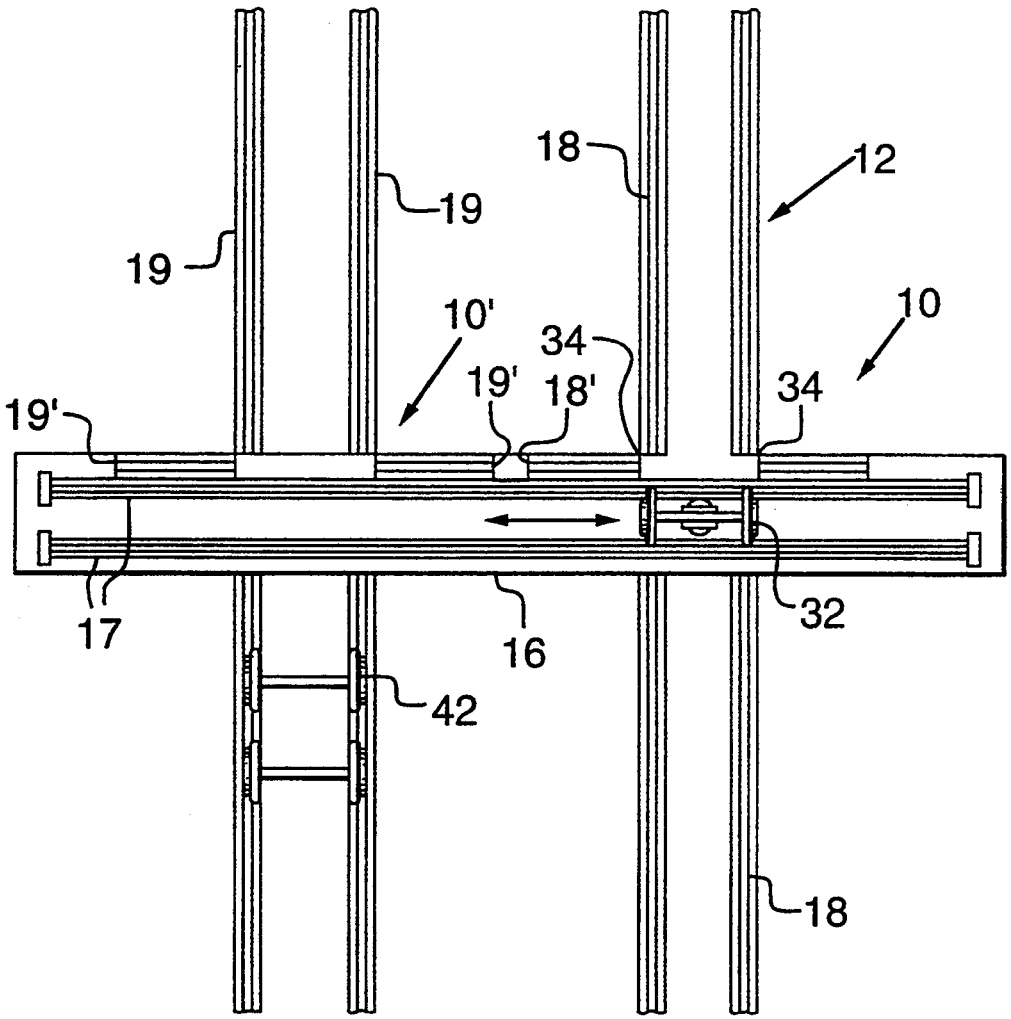
FIG. 2 is a schematic plan view of the arrangement of the service and release tracks and the trench, according to the present invention.

Referring also to FIG. 2, the trench 16 extends (leftwardly) to include a second work station $10^1$ having a release track with rails 19 substantially parallel with the rails 18, with movable reinforced rail portions $19^1$ spanning the trench 16, to permit the transfer of wheel set 32 to the rails 19, with substitution of another wheel set 42 therefor, by appropriate manipulation of the jack 22 and deployment and subsequent retraction of the movable rail portions, $19^1$ and $18^1$.

Turning to FIG. 3, the trolley 20, mounted by wheels 44 upon rails 17 has the jack 22 mounted in the middle section thereof.

A protective tubular housing 23, extending below the body portion of the trolley 20, receives the lower end of the shaft of jack 22 in protective encasement therein, to permit the lowering of the jack yoke 28 by about two to three feet, to the extent illustrated, required to achieve the desired top clearance for the wheel set 32, below the car. A convenient datum line, to ensnare adequate top clearance for the wheels, is the top of the rails 18.

The jack drive motor 26 is illustrated as being in chain-driving, powering relation with a reduction gear drive 50.

This gear 50 is of selected type and reduction ratio to ensure that the jack 22 cannot overhaul.

Figure 4:
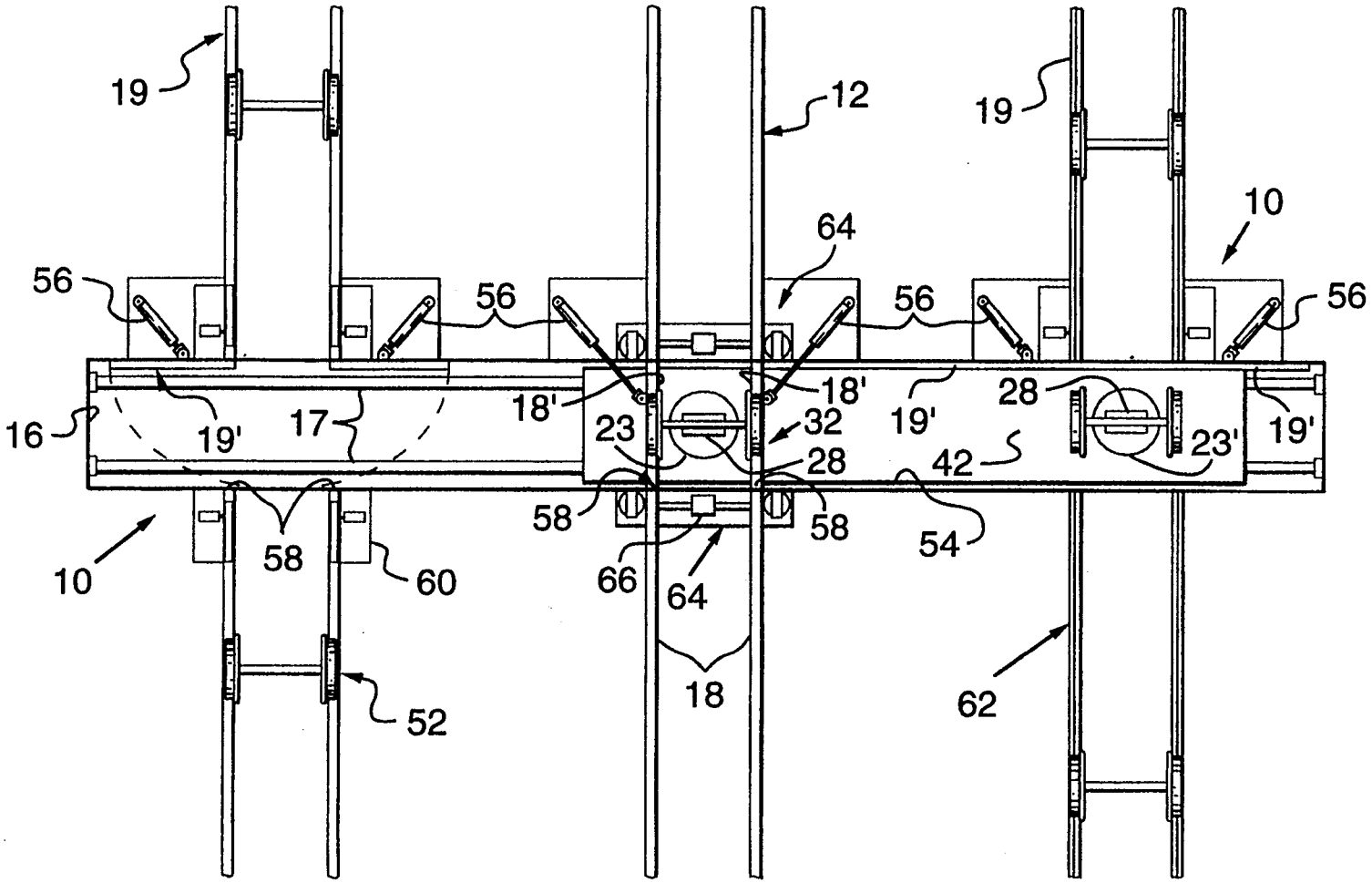
FIG. 4 is a schematic plan view showing a tandem trolley and two adjacent release tracks, with power actuated swing rails for the service track and the release tracks.

Referring to FIG. 4 the trench 16 extends beneath a service track 12 and a pair of release tracks 19. Each of the three tracks has swing rail portions $18^1$ and $19^1$ respectively, each swing rail having a powered linear actuator 56 connected therewith, generally of the double acting hydraulic cylinder type. The swing rails $18^1$ of service line 12 are shown, deployed, and the swing rails of the release tracks 19, $19^1$ are retracted. The right hand release track 19 may be equipped with a wheel set indexing means 62, (See FIGS. 5 and 6).

When in the deployed condition, the swing rail portions $18^1$ and $19^1$ are locked immovably in place by shot pins 58 which positively lock the free ends of swing rail portions $18^1$ to the respective track. These shot pins 58 are activated automatically with the movement of rail portions $18^1$, $19^1$ to the deployed, rail locking position, and require positive withdrawal action, initiated by the operator, in order to retract the shot pins 58, and release the swing rail portions.

Figure 9:
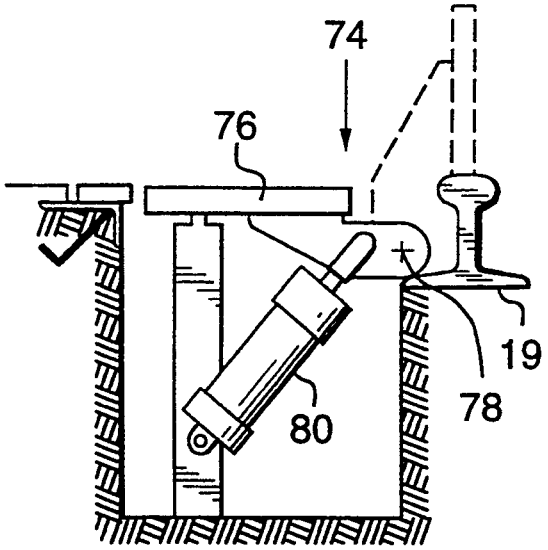
FIG. 9 is a schematic front elevation showing a wheel-stop assembly in its retracted and its deployed positions.
Figure 10:
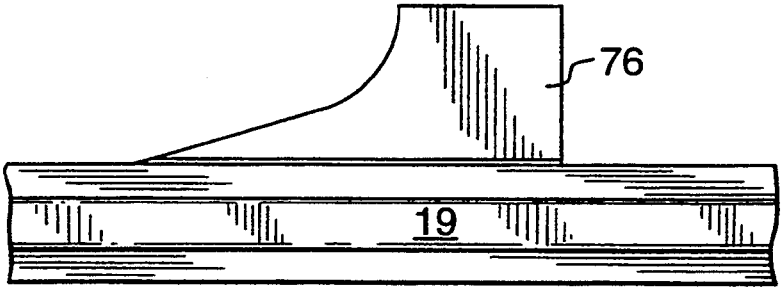
FIG. 10 is a plan view showing the stop portion of the FIG. 9 embodiment, in a retracted position.

A wheel blocking system 64, usually located on both sides of the pit may be automatically deployed into wheel blocking relation on top of the rails, as shown in FIGS. 9 and 10.

A tandem trolley 54 is of a length to span two tracks simultaneously, shown in FIG. 4 as spanning tracks 12 and 62. The trolley 54 has a pair of independently operable jacks 23, $23^1$ located at opposite ends of trolley 54, and permitting work to be carried on, simultaneously at the service track 12 and release track 19; or at service track 12 and the other release track 19.

The term "service track" as used herein may also encompass a main line, whereon regular traffic can normally pass. This enables the servicing of defective wheel units without requiring any break-up of a train, or shunting of the cars or multi-car units.

Adjoining the rails of the service track 12 may be located two pairs of car blocking jacks 64, (See FIG. 7 for detail) one pair on each side of the trench 16. This enables the automated blocking of the front or the rear of a truck, for removing the respective front or rear wheel sets thereof.

Figure 7:
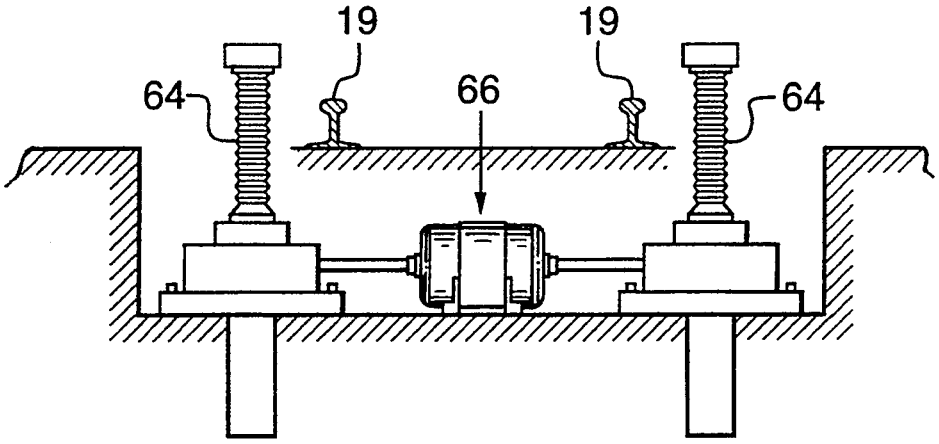
FIG. 7 is a schematic frontal elevation showing a tandem jack, car blocking arrangement, to support a car end or ends in a raised, servicing condition.

Referring to FIG. 7, the two blocking jacks 64 of each blocking set are shown as being mechanical jacks, synchronously driven by an electric motor 66, controlled by the operator.

In addition to enabling the selective replacement of front or rear wheel sets, the provision of two pairs of blocking jacks 64 also enables the blocking of two adjoining ends of a pair of coupled cars, without requiring their uncoupling and disconnection.

Figure 5:
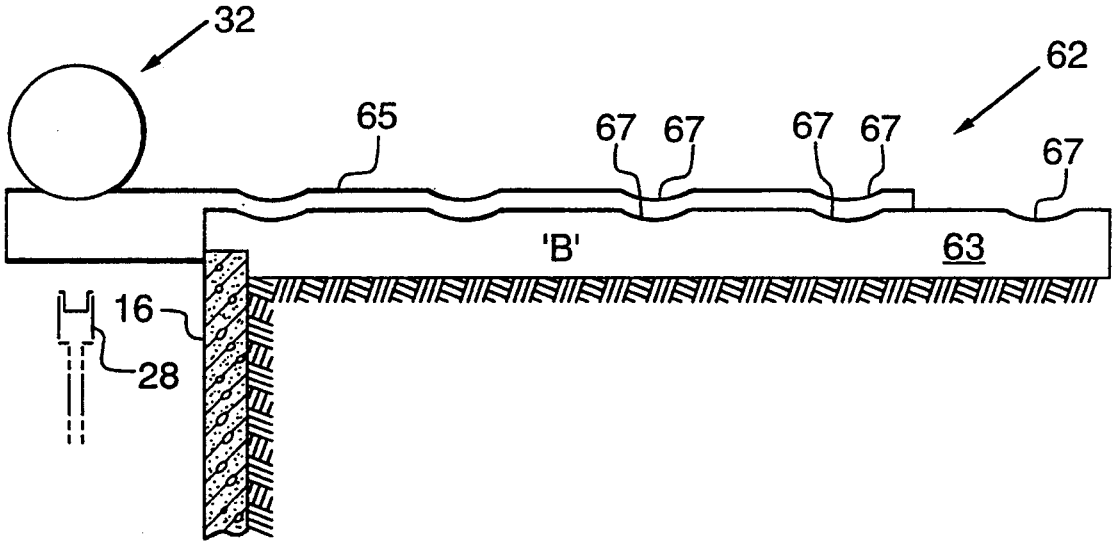
FIG. 5 is a schematic side view of a tandem walking beam for simultaneously transporting a sequence of wheel sets towards or away from the second work station.
Figure 6:
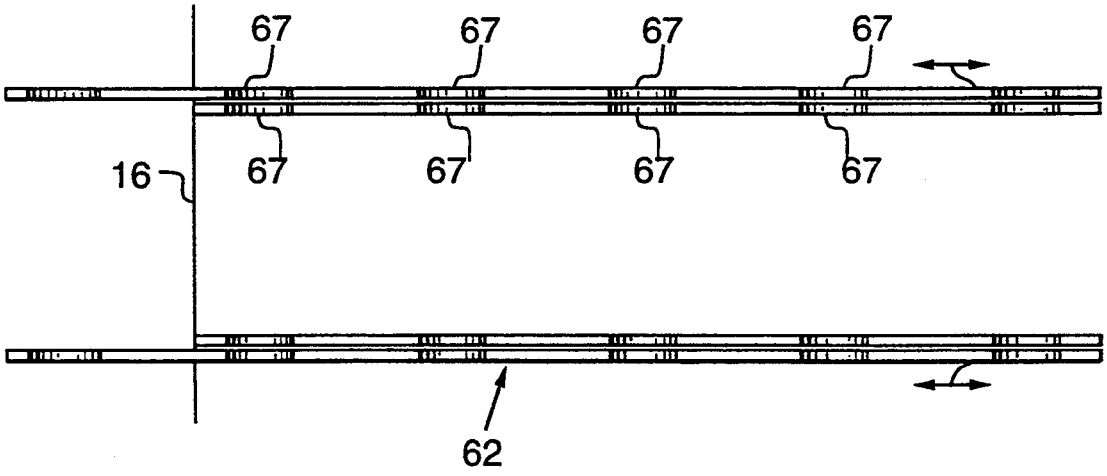
FIG. 6 is a schematic plan view of the walking beam of FIG. 5.

Referring to FIGS. 5 and 6, in relation to one of the release tracks 19 of FIG. 4, beside each rail of track 19 may be located a stationary beam 63 and a longitudinally movable "walking beam" 65 of the wheel set indexing means 62. The walking beam 65 is illustrated in a partially raised "pick-up" position, for picking up and transferring a wheel set from one (pair of) recess in beam 63, to transfer it to an adjacent recess in beam 63.

The beams 63, 65 are each provided with recesses 67 at uniformly spaced intervals in the top surface thereof, to receive wheel sets 32 in secure, non-rolling, resting relation thereon.

The walking beam 65 is vertically and horizontally displaceable, in well known fashion when operated by the operator so as to pick-up a wheel set or sets 32, located in one recess 67 and to transfer them from that recess 67 in the stationary beam 63, to an adjacent recess 67.

The walking beam 65 then returns inactively relative to the wheel sets 32, to the starting position of beam 65.

Thus, successive "steps" of the walking beam 65 can serve to march adjacent wheel sets 32 stepwise along the stationary beam 63.

At the central location, over the centre of trench 16, a respective wheel set 32 may then be picked up from the walking beam 65 by the yoke 28 of a jack 22.

Conversely, a wheel set 32 may be deposited by the yoke 28 of jack 22, upon a recess 67 of walking beam 65, and transferred away from the trench 16, for disposal along track 19.

Figure 8:
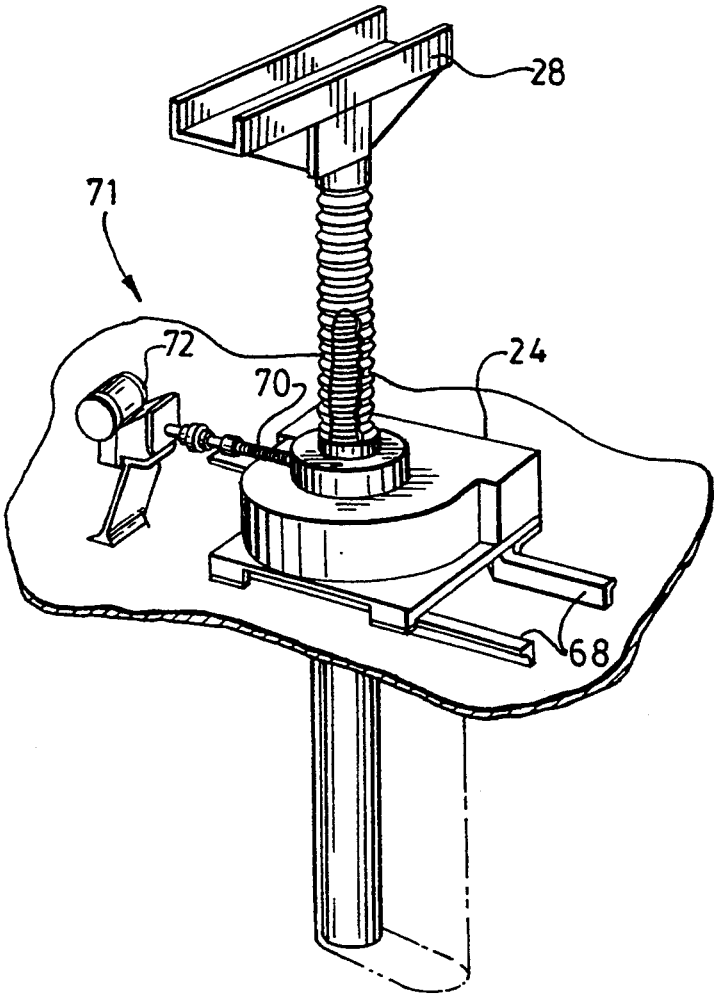
FIG. 8 shows an auxiliary, jack indexing portion of a trolley embodiment having lateral alignment facility.

Referring to FIG. 8, the worm-driven nut mechanism 24, and the associated components of jack 22 may be mounted upon slideway 68, for lateral, indexing relation, relative to the trolley 20. A small, reversible indexing motor 72, in driving relation with a screw 70 of screw nut indexing mechanism 71, permits lateral indexing adjustment of the jack 22 along the slideway 68, across the trolley 20. This permits accommodation of the wheel set pick-up system to any inaccuracy in the positioning of the rail cars upon the track, over the trench 16.

Referring to FIGS. 9 and 10, one of the track rails 19 of the track 19 is illustrated having a wheel stop assembly 74 located adjacent thereto. A shaped chock 76 pivotally mounted at 78 is connected to a double acting actuator 80 for upward pivotal movement into a rail-blocking position, located atop the rail 19. When in their deployed position atop the track 19, the chocks 76 prevent the accidental rolling of a wheel set towards the adjacent trench 16.

The actuation of the chocks 76 may be under direct control of the operator, or by use of limit switches in conjunction with the movement of the swing rails to the retracted position, to prevent access of any wheel sets into the trench.

Figure 11:
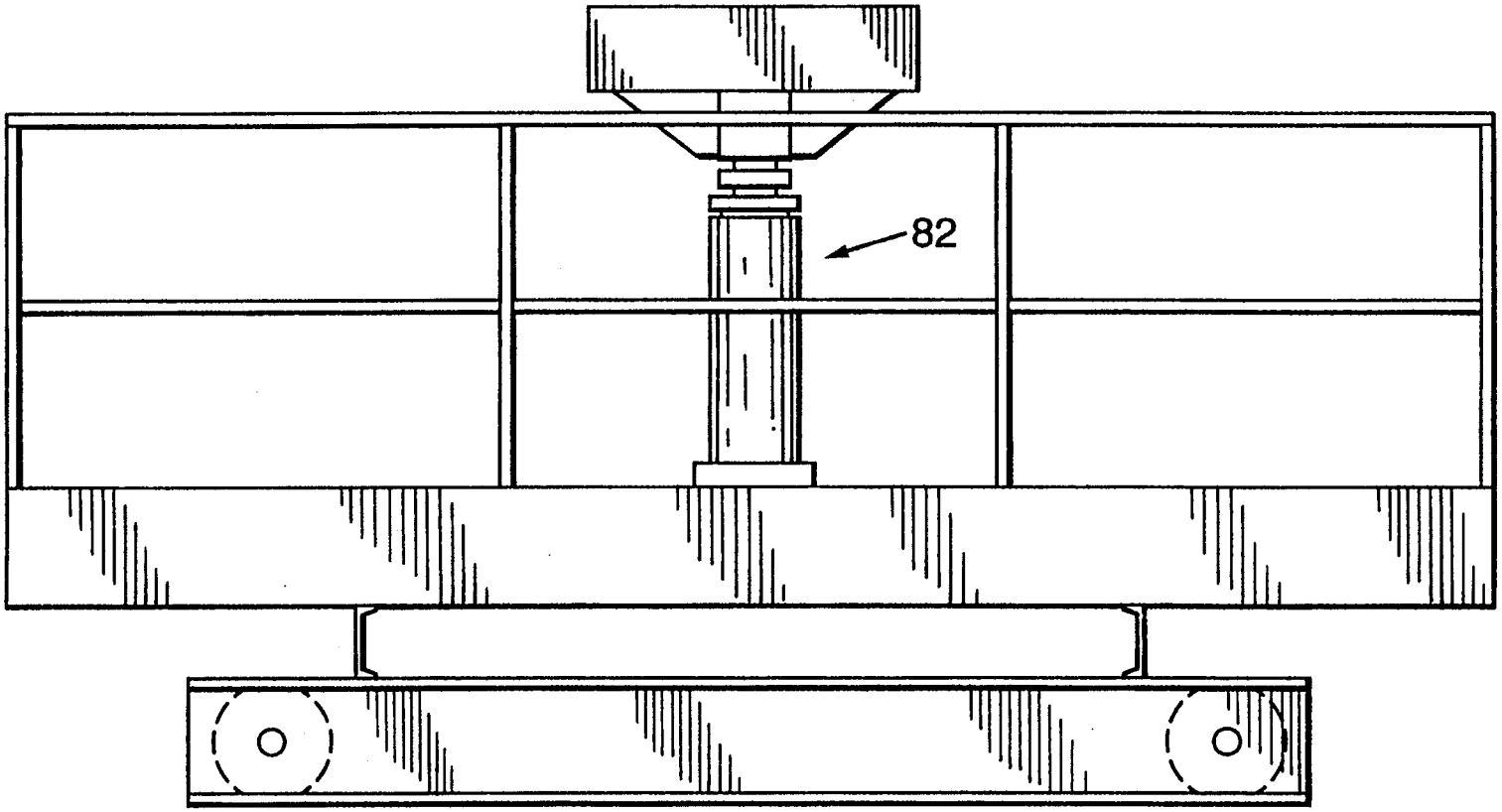
FIG. 11 is a side elevational view of a trolley embodiment incorporating a two-stage hydraulic jack.

Referring to FIG. 11, there is illustrated a trolley according to the present invention incorporating a two stage hydraulic jack 82.

In changing a defective wheel set 32, commencing with one or more sets of replacement wheel set assemblies 42 mustered on the second track 19, and with the train or portion thereof located on the track such that the car which is supported by the wheel set assembly 32 is located upon track rails 18 so as to locate the axle 30 in centered relation over trench 16, the replacement sequence comprises:

1. Position the trolley 20 with the jack 22 centered beneath axle 30;
2. Raise the jack 22 to engage the axle 30 in the U-section yoke 28;
3. Raise the jack 22 to raise axle 30 and its associated car end (and the associated close-coupled adjoining car end, in the case of a pack of cars ) clear of the rails $18^1$;
4. Block the raised car end/ends in the raised condition with suitable supporting blocks;
5. Swing the rail portions $18^1$ outwardly into retracted relation alongside the trench 16;
6. Lower the jack 22 to lower the wheel set 32 clear of the undercarriage of the car;
7. Retract the rail portions $19^1$ of the second work station $10^1$ outwardly into retracted relation along the sides of trench 16;
8. Move the trolley 20 (leftwardly) to the second work station $10^1$;
9. Raise the jack 22 to raise the wheel set 32 above the plane of rails $19^1$;
10. Swing the rail portions $19^1$ inwardly into redeployed relation beneath the wheel set 32;
11. Lower the jack 22 to first set down the wheel set 32 onto the rails $19^1$, and then to lower the yoke 28 below and clear of the axle
12. Move the wheel set 32 out of the second work station $10^1$ and onto release track 19, and move replacement wheel set 42 along the release track 19 into the second work station, positioned above the jack 22;
13. Raise the jack 22 to engage and raise the wheel set 42 clear of the rails $19^1$;
14. Retract the movable rail portions $19^1$;
15. Lower the jack 22;
16. Move the trolley 20 (rightwardly) to work station 10 in aligned relation with the car;
17. Raise the jack 22 for the replacement wheel set 42 to engage the truck saddle, and raise the car end-/ends clear of the supporting blocks;
18. Deploy the rail portions $18^1$ across the trench 16;
19. Lower the jack 22 to position the wheels in supported relation on the rail portions $18^1$, and to retract the jack 22 totally clear of the car; and
20. Return the freight or passenger car in stillcoupled relation in the train back to service.

It will be understood that the subject first work station may be incorporated into a running track, as distinct from a service track, to minimize on-track handling times.

INDUSTRIAL APPLICABILITY

Adoption of the present invention improves the serviceability of railway rolling stock to the extent that it can compete much more effectively with the trucking industry, by reducing servicing down-time for a wheel set change from several hours to less than an hour, and to reduce the out-of-service time for the associated train, including the avoidance of shunting and uncoupling times, from about three days to as little as one half day, with consequent incentive to maintain rolling stock in a safe condition.

What I claim by letters patent of the United States is:

1. A process for electively and rapidly changing a defective wheel set unit of a rail car, wherein the rail car is selected from the group consisting of a single rail car, one car of a plurality of semi-permanently connected rail cars, and a rail car coupled as one unit in a train of cars, comprising the steps of; providing a pair of spaced-apart work stations having a jacking trolley within a trench interconnecting the work stations, said jacking trolley having a high capacity jack thereon; a first said work station extending beneath a service track having rail portions thereof over the trench the rail portions being retractable to position alongside the trench to give substantially unrestricted access between the trolley and the rail car when located thereover; further including the steps of: locating said defective wheel set unit in positioned relation over said jack; raising the jack to engage the axle of the defective wheel set unit; raising the jack to lift said wheel set unit and the end of an associated at least one car clear of the retractable rail portions: blocking said at least one car end in supported, immovable relation; retracting the retractable rail portions, and lowering the jack and said defective wheel set unit below the rail car; withdrawing the trolley together with the wheel set unit to second work station; removing the wheel set unit and substituting a replacement wheel set by lowering said defective wheel set unit onto the track at said second work station, and removing said defective wheel set unit therefrom; wheeling a replacement wheel set unit along said second track to a position over the jack; raising the set unit upon the jack, and retracting retractable rail portions from therebeneath: and moving said trolley and the replacement wheel set unit to said first work station; raising the jack to position the replacement wheel set unit in engaged lifting relation with the associated rail car end; unblocking said at least one car end to enable unrestricted lowering thereof; deploying the retractable rail portions beneath the replacement wheel set unit; lowering the jack to locate the replacement wheel set unit in engaging relation with the rail portions; retracting the jack downwardly clear of the rail car, and returning the rail car into service.

2. A rail servicing installation, comprising a first track to receive a plurality of rail cars coupled as a pack in semi-permanent coupled relation; a first work station having a portion of first retractable rail track thereof spanning a trench located transversely of and beneath the first track; a second track beside said first track and passing over said trench; said second track having a second work station with a second retractable portion of track across said trench; a rail-mounted jacking trolley within said trench movable therealong and selectively positionable within said first and second work stations; said trolley having high capacity retractable jacking means thereon, in use to engage an axle of a wheel set of said rail car pack stationed over said trench, to jack up said axle and raise the ends of adjacent coupled cars of said pack, blocking means to enable blocking up of said raised car ends; said first retractable track portion being retractable to a position clear of said trolley; said jack having a lowering capability to lower said wheel set below said car pack, to permit passage of said trolley and said wheel set within said trench to said second work station, said second retractable portion of track enabling removal of said wheel set onto said second track.

3. The installation as set forth in claim 2, said jacking means including a single ram jack, combined with electrically powered driving means, and a remote control, to enable one-man operation of the installation.

4. The installation as set forth in claim 3, said jack being mechanically driven, including motor means located below a floor portion of said trolley.

5. The installation as set forth in claim 3, said jacking means having lifting capacity for simultaneously raising adjoining ends of a pair of close-coupled passenger cars.

6. The installation as set forth in claim 3, said jacking means having lifting capacity for raising one end of a loaded freight car.

7. The installation as set forth in claim 4, said jack having a threaded ram extensible downwardly below said car, within a protective enclosing cylinder, extending to adjacent the bottom of said trench.

8. The installation as set forth in claim 3, said jacking means having a working lift of at least about three feet.

9. The installation as set forth in claim 3, said jack having a working stroke to permit lowering said wheel set about three feet below said retractable track.

10. The installation as set forth in claim 2, said first track comprising a running track.

11. The installation as set forth in claim 2, said first retractable rail track comprising a pair of power operated swing rails.

12. The installation as set forth in claim 11, said swing rails being at least semi-automatically operated.

13. The installation as set forth in claim 2, said jacking means being mechanically driven.

14. The installation as set forth in claim 2, said jacking means being hydraulically driven.

15. The installation as set forth in claim 2, said rail mounted jacking trolley extending within said trench to simultaneously underlie said first track and said second track; said trolley having two said jacking means in mutually spaced apart relation to each simultaneously underlie a said work station, to enable the carrying out of work with said jacking means simultaneously at said two work stations.

16. The installation as set forth in claim 2, in combination with mechanized blocking means located adjacent the sides of said trench and said first track, to support an end of a said car in raised relation, relative to said dust track.

17. The combination as set forth in claim 16, said blocking means having a first upwardly extendible car support member located to one side of said first track and a second, upwardly extendible car support member located to the other side of said first track.

18. The combination as set forth in claim 17, having said blocking means located on both sides of said first track, and on both sides of said trench, to facilitate blocking of a truck for removal therefrom of a front wheel set or a rear wheel set thereof.

19. The combination as set forth in claim 17, said first and said second car support members being driven by a single actuator, connected in synchronized driving relation therebetween.

20. The installation as set forth in claim 2, including wheel stop means located adjacent said trench and said second track, said wheel stop means being movable, in use from a retracted condition adjacent said second track, to a deployed condition upon said second track, to preclude the rolling passage of said wheel set therepast.

21. The installation as set forth in claim 15, said trolley being movable from said work station to a second track, and from said work station to a third track parallel to said first track, to permit simultaneous wheel set handling by said two tracking means.

22. The installation as set forth in claim 2, said jacking means being mounted on said trolley, for elective displacement of said jacking means laterally of the trolley, into aligned relation with said wheel set.

* * * * *

UNITED STATES PATENT AND TRADEMARK OFFICE

CERTIFICATE OF CORRECTION

PATENT NO. : 5,370,058

DATED : December 6, 1994

INVENTOR(S) : Patrick G. David

It is certified that error appears in the above-identified patent and that said Letters Patent is hereby corrected as shown below:

On title page, item [56] U.S. Patent Documents, "2,652,284" should be —2,652,784—.

On title page, item [57] Abstract, line 15, "tile" should be --the--;

Abstract, line 24, "still coupled" should be --still-coupled--

Col. 1, line 33, "no" should be --to--.

Col. 1, line 36, "tonal" should be --total--.

Col. 6, line 17, "ensnare" should be --ensure--.

Col. 7, line 27, "march" should be --"march"--.

Col. 8, line 29, after "axle" insert --30;--.

Col. 9, line 9, "trench" should be --trench,--.

Col. 9, line 18, "portions:" should be --portions;--.

Col. 9, line 67, delete ","

Col. 10, line 38, "dust" should be --first--.

UNITED STATES PATENT AND TRADEMARK OFFICE

CERTIFICATE OF CORRECTION

PATENT NO. : 5,370,058

DATED : December 6, 1994

INVENTOR(S) : Patrick G. David

It is certified that error appears in the above-indentified patent and that said Letters Patent is hereby corrected as shown below:

Column 10, line 63, "tracking" should be —jacking—.

Signed and Sealed this

Twenty-seventh Day of June, 1995

*Attest:*

Bruce Lehman

BRUCE LEHMAN

*Attesting Officer*

*Commissioner of Patents and Trademarks*